US008598477B2

(12) United States Patent
Garvin et al.

(10) Patent No.: US 8,598,477 B2
(45) Date of Patent: Dec. 3, 2013

(54) UNIVERSAL SWITCH RESTRAINT DEVICE

(76) Inventors: Barton L. Garvin, Western Springs, IL (US); Walter Ejsmont, Lemont, IL (US)

( * ) Notice: Subject to any disclaimer, the term of this patent is extended or adjusted under 35 U.S.C. 154(b) by 299 days.

(21) Appl. No.: 12/902,069

(22) Filed: Oct. 11, 2010

(65) Prior Publication Data

US 2011/0162942 A1 Jul. 7, 2011

Related U.S. Application Data

(60) Provisional application No. 61/251,195, filed on Oct. 13, 2009.

(51) Int. Cl.
*H01H 3/20* (2006.01)

(52) U.S. Cl.
USPC ..... 200/43.21; 200/43.14

(58) Field of Classification Search
USPC ..... 200/43.21
See application file for complete search history.

(56) References Cited

U.S. PATENT DOCUMENTS

| | | | | |
|---|---|---|---|---|
| 3,610,849 | A | 10/1971 | Lehman et al. | 200/42 |
| 3,624,321 | A | 11/1971 | Puetz et al. | 200/42 |
| 3,723,677 | A | 3/1973 | Arias | 200/44 |
| 3,816,677 | A | 6/1974 | Soltez | 200/42 |
| 3,898,398 | A | 8/1975 | Borst et al. | 200/44 |
| 3,959,609 | A | 5/1976 | Laing et al. | 200/4 |
| 3,982,082 | A | 9/1976 | Thorud et al. | 200/44 |
| 4,079,214 | A | 3/1978 | Castonguay et al. | 200/50 |
| 4,187,420 | A | 2/1980 | Piber | 200/321 |
| 4,292,483 | A | 9/1981 | Roytberg | 200/42 |
| 4,435,624 | A | 3/1984 | Sepulveda | 200/42 |
| 4,467,152 | A | 8/1984 | Gordy | 200/42 |
| 4,623,765 | A | 11/1986 | Leyden | 200/43.22 |
| 4,820,887 | A | 4/1989 | Schmitz | 200/43.18 |
| 5,120,236 | A | 6/1992 | Gilbert | 439/133 |
| 5,165,528 | A | 11/1992 | Kozlowski et al. | 200/43.15 |
| 5,181,602 | A | 1/1993 | Kozlowski et al. | 200/43.015 |
| 5,219,066 | A | 6/1993 | Jameson | 200/42.01 |
| 5,260,528 | A * | 11/1993 | Benda | 200/43.14 |
| 5,293,011 | A | 3/1994 | Mokert | 200/43.14 |
| 5,310,969 | A | 5/1994 | Turek et al. | 200/43.14 |
| 5,322,980 | A | 6/1994 | Benda | 200/43.014 |
| 5,432,308 | A | 7/1995 | Howie, Jr. | 200/43.14 |
| 5,440,089 | A | 8/1995 | Prokop | 200/321 |
| 5,463,196 | A | 10/1995 | Darimont | 200/43.16 |
| 5,467,622 | A | 11/1995 | Becker et al. | 70/203 |
| 5,473,127 | A | 12/1995 | Falcon et al. | 200/43.04 |
| 5,477,016 | A | 12/1995 | Baginski et al. | 200/43.11 |
| 5,504,284 | A | 4/1996 | Lazareth et al. | 200/50 |
| 5,521,344 | A | 5/1996 | DeLeo | 200/43.14 |
| 5,543,593 | A | 8/1996 | Turek | 200/43.11 |
| 5,558,209 | A | 9/1996 | Mohsen | 200/43.22 |
| 5,577,599 | A | 11/1996 | Turek et al. | 200/43.14 |
| 5,593,020 | A | 1/1997 | Alexander | 200/43.14 |

(Continued)

*Primary Examiner* — Kyung Lee
*Assistant Examiner* — Lheiren Mae Caroc
(74) *Attorney, Agent, or Firm* — J. Peter Paredes; Rosenbaum IP

(57) ABSTRACT

A universal restraint device for a switch handle includes a channel adapted to accommodate the switch handle. The channel includes a base wall, first and second side walls that extend generally perpendicularly from the base wall, and first and second feet that extend toward one another from distal ends of the first and second side walls. The channel includes a width defined by a distance measured between the first and second side walls. A lever arm extends from the base wall a distance greater than the width of the channel.

20 Claims, 5 Drawing Sheets

(56) References Cited

U.S. PATENT DOCUMENTS

| | | | | |
|---|---|---|---|---|
| 5,731,763 | A | 3/1998 | Herweck et al. | 340/825.69 |
| 5,732,575 | A | 3/1998 | Kaveney | 70/2 |
| 5,732,815 | A | 3/1998 | Brouwer | 200/43.14 |
| 5,817,998 | A | 10/1998 | Siebels et al. | 200/43.14 |
| 5,817,999 | A | 10/1998 | Mugan et al. | 200/50.11 |
| 5,868,242 | A | 2/1999 | Hall et al. | 200/43.14 |
| 5,886,426 | A | 3/1999 | Kim | 307/142 |
| 5,900,600 | A | 5/1999 | Alexander et al. | 200/43.14 |
| 5,969,312 | A | 10/1999 | Svetlik et al. | 200/61.85 |
| 6,049,045 | A | 4/2000 | Becker et al. | 200/51 |
| 6,057,518 | A | 5/2000 | Bascom et al. | 200/43.17 |
| 6,118,088 | A | 9/2000 | Thielman | 200/43.16 |
| 6,122,944 | A | 9/2000 | Chandra et al. | 70/388 |
| 6,160,227 | A | 12/2000 | Singer | 200/43.14 |
| 6,266,231 | B1 | 7/2001 | Donahue et al. | 361/631 |
| 6,288,350 | B1 | 9/2001 | Campbell et al. | 200/321 |
| 6,340,802 | B1 | 1/2002 | Bascom et al. | 200/43.17 |
| 6,371,516 | B1 | 4/2002 | Miyagawa | 280/735 |
| 6,396,008 | B1 | 5/2002 | Maloney et al. | 200/43.14 |
| 6,437,261 | B1 | 8/2002 | Bryant et al. | 200/43.16 |
| 6,469,264 | B2 * | 10/2002 | Benda | 200/43.14 |
| 6,512,188 | B2 | 1/2003 | Campbell et al. | 200/321 |
| 6,538,218 | B2 | 3/2003 | Bascom et al. | 200/43.17 |
| 6,596,952 | B1 | 7/2003 | Degrazia et al. | 200/330 |
| 6,617,532 | B1 | 9/2003 | Turek | 200/43.14 |
| 6,696,651 | B1 | 2/2004 | Koopmeiners et al. | 200/43.14 |
| 6,734,379 | B1 | 5/2004 | Savadian et al. | 200/41.01 |
| 6,753,490 | B2 | 6/2004 | Svetlik et al. | 200/321 |
| 6,759,609 | B1 | 7/2004 | Henderson et al. | 200/43.11 |
| 6,844,512 | B2 | 1/2005 | Benda | 200/43.14 |
| 6,855,895 | B2 | 2/2005 | Santa Cruz et al. | 200/43.11 |
| 6,861,598 | B2 | 3/2005 | Bascom et al. | 200/43.17 |
| 6,872,898 | B2 | 3/2005 | Mohtasham | 200/43.01 |
| 6,949,711 | B1 | 9/2005 | Litteer | 200/43.01 |
| 6,963,037 | B1 | 11/2005 | Bennett et al. | 200/43.22 |
| 6,989,499 | B2 | 1/2006 | Bortolloni et al. | 200/50.05 |
| 7,137,178 | B1 | 11/2006 | Daume et al. | 24/633 |
| 7,148,435 | B2 | 12/2006 | Lau et al. | 200/43.14 |
| 7,223,927 | B2 | 5/2007 | Poyner | 200/43.04 |
| 7,227,079 | B2 | 6/2007 | Noest et al. | 174/50 |
| 7,262,376 | B2 | 8/2007 | Brojanac et al. | 200/43.14 |
| 7,348,504 | B2 | 3/2008 | Brojanac | 200/43.22 |
| 7,371,980 | B2 | 5/2008 | Marshall | 200/43.11 |
| 7,442,888 | B2 | 10/2008 | Puddicombe, II et al. | 200/43.04 |
| 7,501,593 | B2 | 3/2009 | Brojanac | 200/43.14 |
| 7,551,047 | B2 | 6/2009 | Sokolow et al. | 335/6 |
| 7,681,421 | B2 | 3/2010 | Cannon | 70/14 |
| 7,868,719 | B2 | 1/2011 | Bazayev et al. | 335/18 |
| 7,928,330 | B2 | 4/2011 | Poyner et al. | 200/43.07 |
| 7,977,590 | B2 | 7/2011 | Brojanac | 200/43.14 |
| 2002/0056618 | A1 | 5/2002 | Bascom et al. | 200/43.17 |
| 2002/0100666 | A1 | 8/2002 | Benda | 200/43.14 |
| 2002/0139646 | A1 | 10/2002 | Karlicek | 20/43.14 |
| 2003/0098221 | A1 | 5/2003 | Bhusri et al. | 200/43.01 |
| 2003/0136652 | A1 | 7/2003 | Bascom et al. | 200/43.17 |
| 2004/0069602 | A1 | 4/2004 | Mohtasham | 200/43.01 |
| 2004/0251116 | A1 | 12/2004 | Cruz et al. | 200/43.11 |
| 2006/0151306 | A1 | 7/2006 | Lau et al. | 200/43.14 |
| 2006/0266631 | A1 | 11/2006 | Kalous et al. | 200/43.14 |
| 2006/0278504 | A1 | 12/2006 | Brojanac | 200/43.01 |
| 2007/0039806 | A1 | 2/2007 | Puddicombe, II et al. | 200/43.04 |
| 2007/0084705 | A1 | 4/2007 | Marshall | 200/43.11 |
| 2007/0163863 | A1 | 7/2007 | Mitchell et al. | 200/43.04 |
| 2007/0187216 | A1 | 8/2007 | McCoy | 200/43.13 |
| 2007/0235300 | A1 | 10/2007 | Germain et al. | 200/43.02 |
| 2007/0284228 | A1 | 12/2007 | McCoy | 200/43.01 |
| 2007/0289850 | A1 | 12/2007 | McCoy | 200/43.01 |
| 2007/0289851 | A1 | 12/2007 | McCoy | 200/43.01 |
| 2007/0289852 | A1 | 12/2007 | McCoy | 200/43.01 |
| 2008/0067043 | A1 | 3/2008 | Brojanac | 200/43.16 |
| 2008/0078658 | A1 | 4/2008 | Poyner et al. | 200/43.07 |
| 2008/0081494 | A1 | 4/2008 | Larsen et al. | 200/43.02 |
| 2008/0105521 | A1 | 5/2008 | Marshall | 200/43.11 |
| 2008/0142343 | A1 | 6/2008 | Manz | 200/43.11 |
| 2009/0045037 | A1 | 2/2009 | Poyner | 200/43.11 |
| 2009/0205934 | A1 | 8/2009 | Brojanac | 200/43.14 |
| 2009/0219118 | A1 | 9/2009 | Anderson | 200/43.11 |
| 2010/0133074 | A1 | 6/2010 | Eppe et al. | 200/43.16 |
| 2010/0276261 | A1 | 11/2010 | Mittu et al. | 200/43.14 |

* cited by examiner

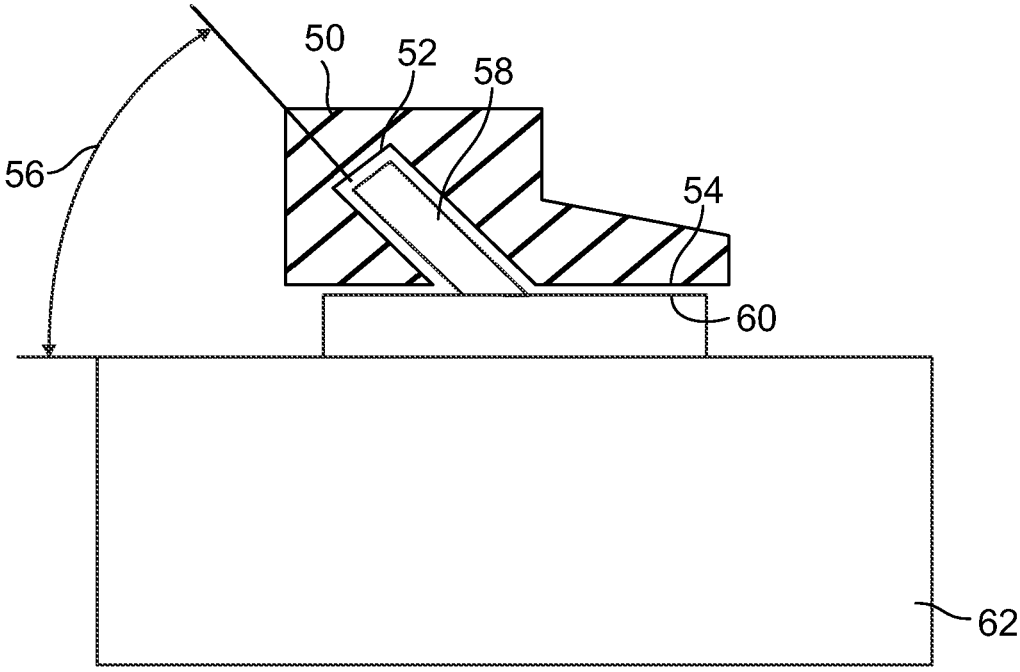
FIG. 1 - Prior Art
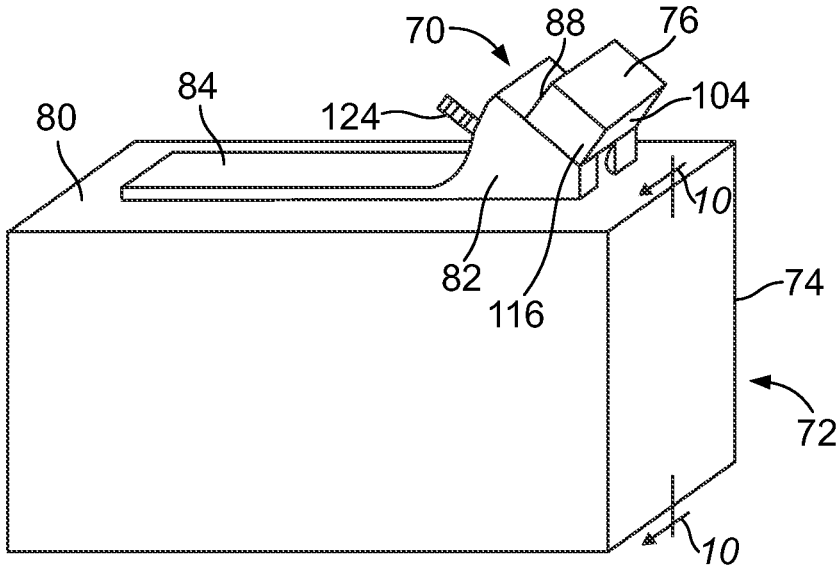
FIG. 2

UNIVERSAL SWITCH RESTRAINT DEVICE

CROSS-REFERENCE TO RELATED APPLICATIONS

This application claims priority to U.S. Provisional Patent Application Ser. No. 61/251,195, filed Oct. 13, 2009.

FIELD OF INVENTION

The present invention relates to the field of electrical systems and repairs thereof. In particular, the present invention relates to a device that can be secured to a switch handle to inhibit the handle from moving relative to the switch.

BACKGROUND OF THE INVENTION

In some circumstances it may be necessary to restrain a switch from being turned on or off. For example, rules promulgated by the Occupational Safety and Health Administration (OHSA) require a circuit breaker to be "locked-out," i.e., restrained from being switched from an off position to an on position, for safety purposes to allow an individual to repair or install electrical equipment powered via the circuit breaker.

Manufacturers of circuit breakers have developed a variety of devices for restraining individual circuit breaker switches. One such device disclosed in U.S. Pat. No. 4,347,412 is illustrated herein in FIG. 1. An inclined groove 52 extends into a surface 54 of the restraint device 50 at an angle 56 and accommodates a switch handle 58. When the restraint device 50 is mounted on the switch handle 58 the inclined groove 52 engages the switch handle 58 and the surface 54 engages a surface 60 of a switch housing 62, thereby inhibiting the switch handle 58 from moving relative to the switch housing 62.

Manufacturers may design the housing and switch handle of a circuit breaker switch such that only their respective restraint devices can interface therewith. For example, the housing may have a lip, groove, or ridge at a fixed distance from the switch handle such that the manufacturer's restraint device may be compatible with the circuit breaker switch, but restraint devices produced by competing manufacturers may not. A risk exists that an individual may place an incompatible restraint device on a circuit breaker resulting in failure of the restraint device and potential injury to the individual. Another problem with available switch restraint devices is their bulkiness. U.S. Pat. Nos. 5,079,390 and 5,147,991 each disclose a circuit breaker restraint device having a member whose width is equal to that of a switch handle. The large size of these restraint devices requires a significant amount of material and raises the cost of the restraint device. A need, therefore, exists for a universal switch restraint device that can be used without modification with a multiplicity of brands of circuit breakers.

SUMMARY OF THE INVENTION

In one aspect of the invention, a universal restraint device for a switch handle that projects through an aperture in a switch housing is presented. The universal restraint device comprises a collar member forming a channel therethrough and adapted to engage the switch handle. A blocking member extends from the collar member and is configured to contact the switch housing external to the aperture when the collar member engages the switch handle.

In another aspect of the invention, a universal restraint device for a switch handle is presented. The universal restraint device comprises a channel adapted to accommodate the switch handle and having first and second planar ends. A lever arm extends from the channel a distance greater than the greatest dimension measured transversely across the channel.

In a further aspect of the invention, a universal restraint device for a switch handle is presented. The universal restraint device comprises a channel adapted to accommodate the switch handle. The channel includes a base wall, first and second side walls that extend generally perpendicularly from the base wall, and first and second feet that extend toward one another from distal ends of the first and second side walls. The channel includes a width defined by a distance measured between the first and second side walls. A lever arm extends from the base wall a distance greater than the width of the channel.

BRIEF DESCRIPTION OF THE DRAWINGS

FIG. 1 is cross-sectional view of a restraint device disclosed in the prior art.

FIG. 2 is an isometric view of an embodiment of a universal restraint device engaging an electrical switch.

Other aspects and advantages of the present invention will become apparent upon consideration of the following detailed description, wherein similar structures have similar reference numerals.

DETAILED DESCRIPTION OF THE PREFERRED EMBODIMENTS

Figure 8:
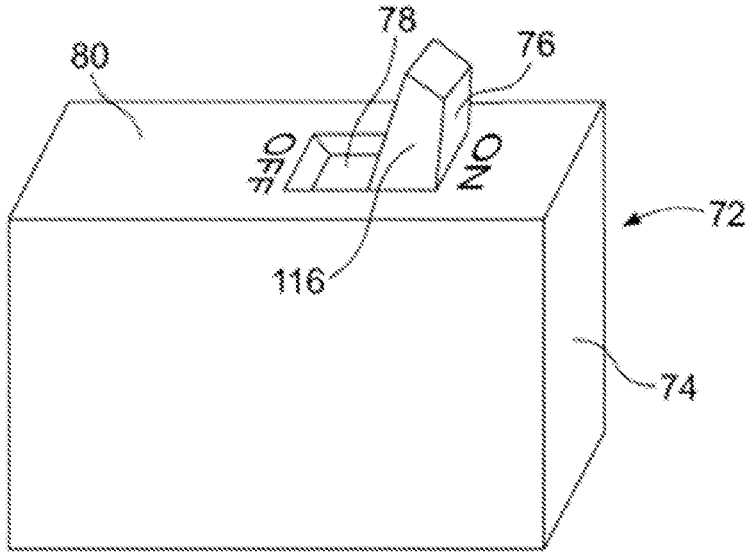
FIG. 8 is an isometric view of an electrical switch.
Figure 10:
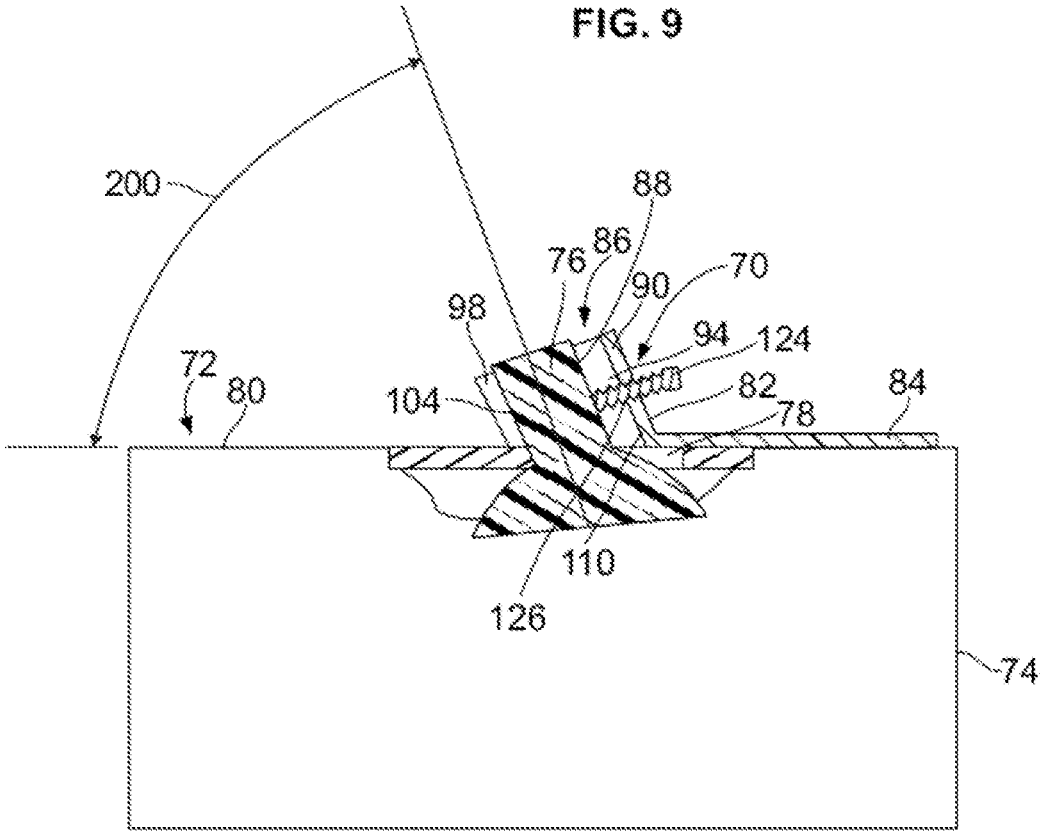
FIG. 10 is a partial cross-sectional view taken generally along the lines 10-10 of FIG. 2.

Referring to FIGS. 2 and 10, in one embodiment of the present invention, a universal restraint device 70 engages an electrical switch 72 that includes a switch housing 74 and a switch handle 76. The switch handle 76 extends through an aperture 78 (FIGS. 8 and 10) disposed through a switch panel 80 on a side of the switch housing 74. The switch panel 80 may have any shape as known in the art, for example, the switch panel 80 may have a generally rectangular planar shape, as illustrated in FIGS. 2 and 8. In operation, the electrical switch 72 may be inserted into a circuit breaker board (not shown) such that only the switch panel 80 is exposed. The switch handle 76 is adapted to be moved by a user between ON and OFF positions (see FIG. 8). As illustrated in FIG. 10, the switch handle 76 in either the ON or OFF positions may form an acute angle 82 with the switch panel 80. Movement of the switch handle 76 between the ON and OFF positions may consist of either rotation and/or translation relative to the switch housing 74.

Referring now to FIGS. 2-7 and 10, the universal restraint device 70 includes a collar member 82 adapted to receive the switch handle 76 such that it substantially or wholly surrounds at least a portion of the switch handle 76 when deployed. The universal restraint device 70 further includes a blocking member or lever arm 84 attached to the collar member 82. The blocking member 84 may be integral with the collar member 82 or may be manufactured as a separate component and subsequently attached to the collar member 82 using any common method of attachment as known in the art, including, without limitation, by welding or use of fasteners directly connecting the two components, one to the other, or indirectly by attachment of each to a single bracket. The universal restraint device 70 may be manufactured from any suitable material conventionally used to make fasteners, such as, without limitation intended, steel, stainless steel, copper, aluminum alloy, polyethylene, polyvinyl chloride, and polypropylene. A non-conducting material may be used to form the universal restraint device 70 in order to reduce the risk of electrical shock. The material usefully employed for the fasteners is suitable to the extent that it exhibits similar integrity and strength as are associated with the above-identified materials.

Figure 5:
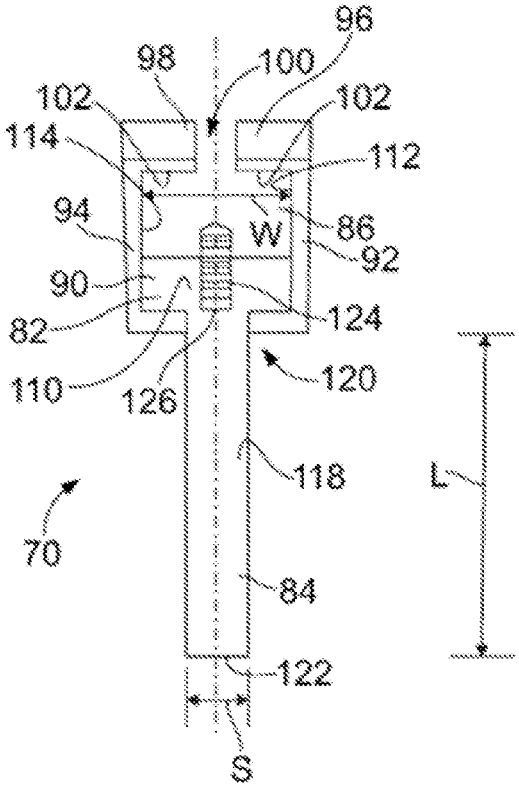
FIG. 5 is an elevational view of a second side of the universal restraint device of FIG. 2.
Figure 7:
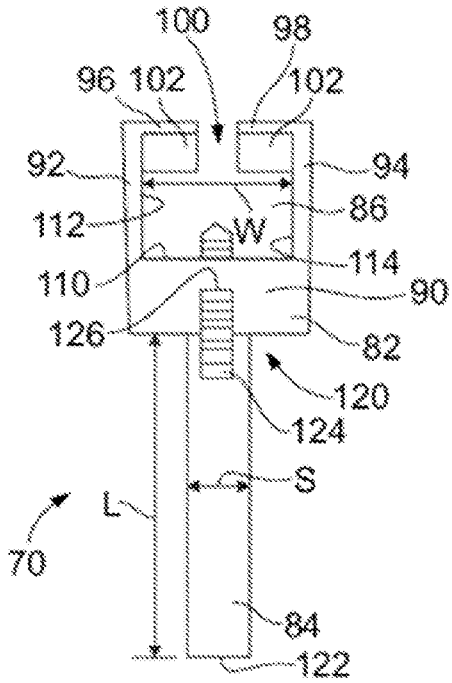
FIG. 7 is an elevational view of a third side of the universal restraint device of FIG. 2.

Referring to FIGS. 5 and 7, the collar member 82 defines a passage or channel 86 through which the switch handle 76 protrudes when the universal restraint device 70 engages the electrical switch 72. The collar member 82 may surround the perimeter of the switch handle 76 wholly (not shown) or leave a portion of the surface 88 of the switch handle 76 exposed as shown in FIGS. 2 and 10. Yet further alternative embodiments of the collar member 82 expose additional amounts of the perimeter of the switch handle 76 on one of more sides thereof.

Figure 4:
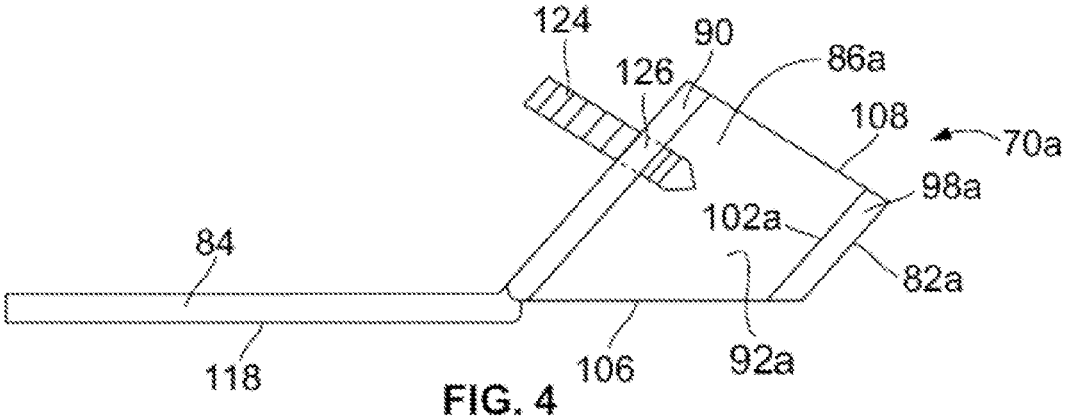
FIG. 4 is an elevational view of a first side of another embodiment of a universal restraint device.
Figure 6:
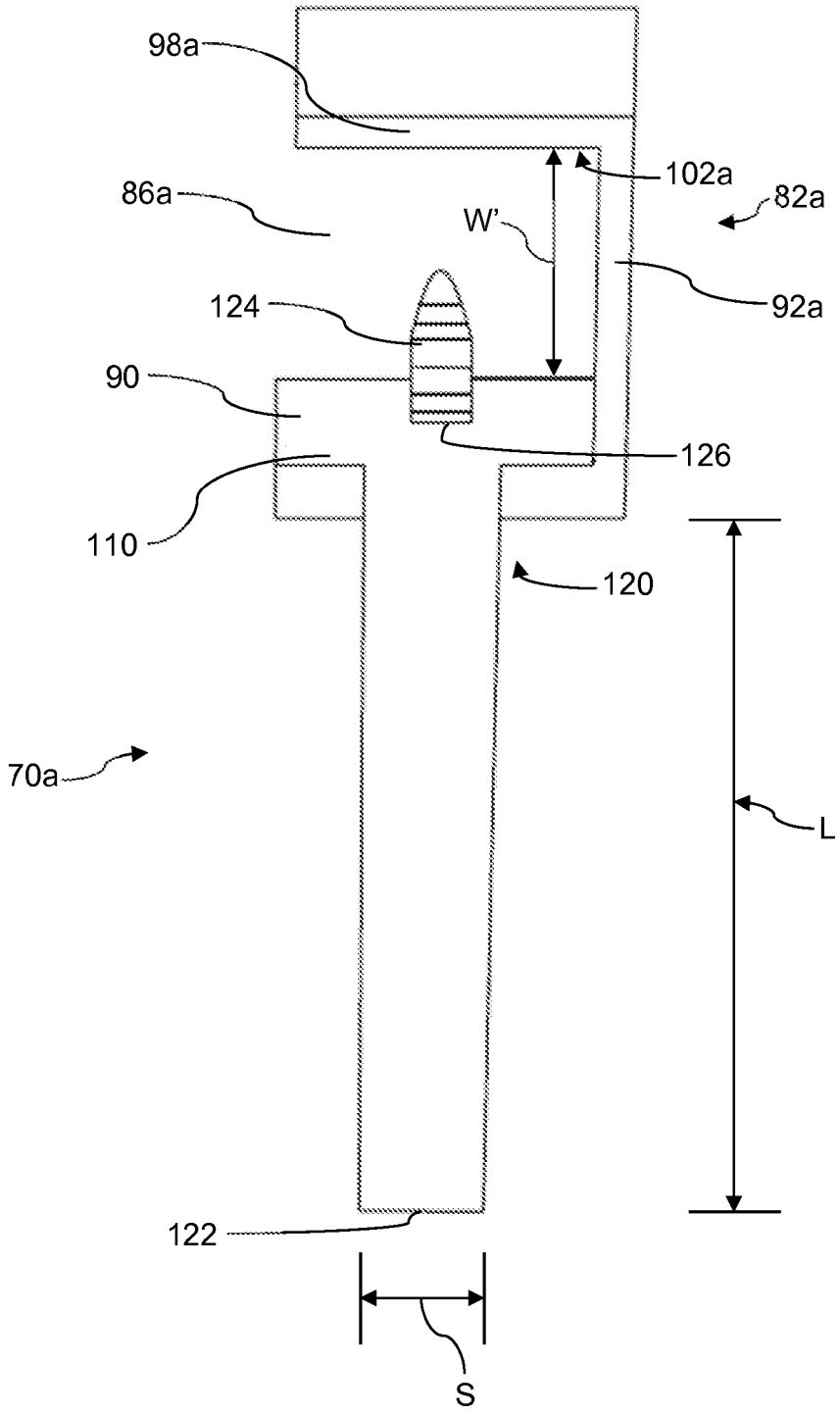
FIG. 6 is an elevational view of a second side of the universal restraint device of FIG. 4.

Referring to FIGS. 4 and 6, in another embodiment of a universal restraint device 70*a*, all of one side face of the switch handle 76 is exposed, thereby allowing such an embodiment to be usefully employed with switch handles having any width that may extend through the uncovered portion of the switch handle. For example, as illustrated in FIGS. 4 and 6, the universal restraint device 70*a* includes a collar member 82*a* that defines a channel 86*a* and that does not cover or contact the switch handle 76 on its lateral surface 116 (See FIGS. 2 and 8) upon engagement with the switch handle 76. Once the universal restraint device 70*a* is secured to the switch handle 76 by means, for example, of fastener 124, then the switch handle 76 is impeded from switching from whichever position it was in to its opposite position.

Referring to FIGS. 5 and 7, the channel 86 of the collar member 82 is defined by a base wall 90, first and second side walls 92, 94 that extend generally perpendicularly from the base wall 90, and first and second feet 96, 98 that extend toward one another from distal ends of the first and second side walls 92, 94, respectively. The channel 86 of the collar member 82 is dimensioned such that any conventional switch handle 76 may extend through the channel 86. In addition, gap 100 between distal ends of the first and second feet 96, 98 allows the channel 86 to be flexibly adjustable. When the universal restraint device 70 engages the switch handle 76, interior surfaces 102 of the first and second feet 96, 98 abut a surface 104 (See FIGS. 2 and 10) of the switch handle 76.

Referring to FIG. 6, the channel 86*a* of the collar member 82*a* is defined by the base wall 90, a side wall 94*a* that extends generally perpendicularly from the base wall 90, and a top wall 98*a* that extends generally perpendicularly from a distal end of the side wall 94*a*.

Figure 3:
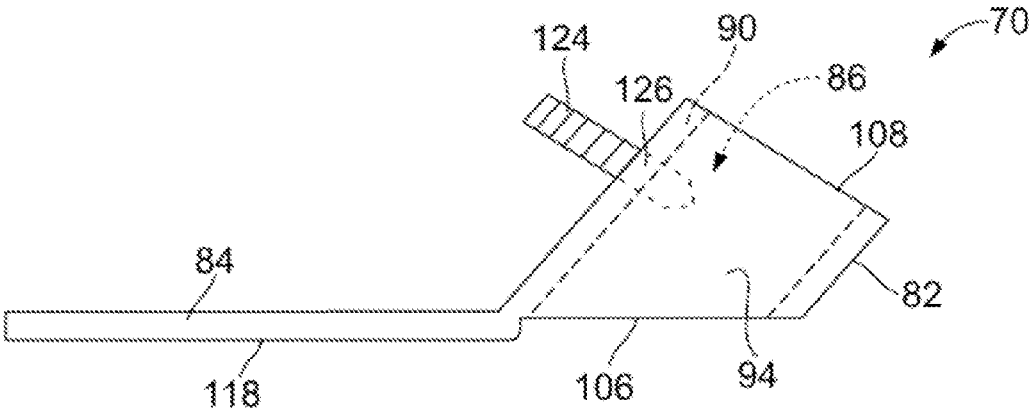
FIG. 3 is an elevational view of a first side of the universal restraint device of FIG. 2.

The channel 86, 86*a* includes first and second ends 106, 108 that are each generally planar, as illustrated in FIGS. 3 and 4. In one embodiment, the blocking member 84 extends from the base wall 90 substantially parallel to the first end 106 of the channel 86, 86*a*.

The channel 86 of the collar member 82 may be dimensioned to form a press fit with the switch handle 76. For example, the surfaces 102 and an interior surface 110 of the base wall 90 of the collar member 82 may be in flush contact with the surfaces 104 and 88 of the switch handle 76, respectively, and/or interior surfaces 112, 114 of the side walls 92, 94 may be in flush contact with lateral surfaces 116 of the switch handle 76. Similarly, the channel 86*a* of the collar member 82*a* may be dimensioned to form a press fit with the switch handle 76 via flush contact between the surfaces 88 and 110 and between the surface 104 and an interior surface 102*a* of the top wall 98*a*.

Referring to FIGS. 2-7, the blocking member 84 includes a contact surface 118 that is adapted to make substantial contact with the switch panel 80 external to the aperture 78. Accordingly, the contact surface 118 may be substantially planar and may have any shape as desired, for example, rectangular as illustrated in FIGS. 5 and 6. The surface 118 is generally parallel to the switch panel 80 when the universal restraint device 70, 70*a* engages the electrical switch 72.

The blocking member 84 extends away from the collar member 82, 82*a* generally in the direction of motion of the switch handle 76 that the universal restraint device 70, 70*a* is configured to prevent. The blocking member 84 has a long dimension or length, L, measured between a proximal end 120 attached to the base wall 90 and a distal end 122 of the blocking member 84. The channel 86 has a greatest internal dimension measured transversely across the channel 86 between opposite internal surfaces thereof. For example, the greatest transverse internal dimension of the channel 86 may be a width, W, measured between the interior surfaces 112, 114 of the side walls 92, 94, as illustrated in FIGS. 5 and 7. Similarly, the channel 86*a* may, for example, have a greatest internal dimension, W', measured transversely across the channel 86*a* between the surface 110 and the interior surface 102*a* of the top wall 98*a*, as illustrated in FIG. 6.

The length L of the blocking member 84 is configured to be a length greater than the greatest transverse internal dimension W, W' of the channel 86, 86*a*, respectively. This configuration provides a blocking member sufficiently long to make contact with the switch panel 80 exterior to the aperture 78 so long as the channel 86, 86*a* fits over the switch handle 76. Furthermore, more contact between the blocking member 84 and the switch panel 80 may increase friction therebetween and prevent slippage of the universal restraint device 70, 70*a* relative to the electrical switch 72.

The blocking member 84 has a short dimension, S, measured transverse to the long dimension L. The short dimension, S, may be configured to be less than the greatest transverse internal dimension of the channel 86, 86*a*, as illustrated in FIGS. 5-7. This configuration may be useful in application of multiple universal restraint devices 70, 70*a* to multiple electrical switches 72 that are arranged next to one another within a confined space.

In other embodiments, in addition to or instead of being configured substantially parallel to the first end 106, the blocking member 84 may form an angle with the first end 106. An angled blocking member 84 may be useful in some circumstances given the geometry and/or contours of the switch housing 74, which may vary between brands of electrical switches 72.

Not wishing to be bound by theory, the blocking member 84 acts as a lever arm that provides a reaction moment in response to rotational movement of the switch handle 76. Any force applied to move the switch handle 76 from the ON position to the OFF position (or vice versa depending on the configuration of the universal restraint device 70, 70*a* and switch handle 76) causes the switch panel 80 to produce an equal and opposite reaction force in the blocking member 84 that substantially eliminates movement of the switch handle 76. The blocking member 84 transfers this reaction force to the switch handle 76 via the collar member 82, 82*a*, which operatively grips the switch handle 76 when a force is applied to move the switch handle 76.

The interior surface 110 of the base wall 90 may contact the surface 88 of the switch handle 76. The interior surface 110 may be positionally adjustable such that an interior dimension measured between the interior surface 110 and surfaces 102 may be altered to allow the collar member 82, 82*a* to be able to universally grip a variety of switch handles 76 having a variety of shapes and sizes.

Alternatively, an adjustable fastener 124, such as, for example, a set screw, may extend through a threaded aperture 126 disposed through the base wall 90 and impinge the surface 88 of the switch handle 76. The distance that the fastener 124 extends into the channel 86, 86*a* may be adjusted by rotating the fastener 124 through the threaded hole 126. The fastener 124 creates friction between the collar member 82, 82*a* and the switch handle 76 to increase the effectiveness of the grip there between. Additionally, the fastener 124 transfers the hereinabove described reaction force produced in the blocking member 84 to the surface 88 of the switch handle 76 thereby inhibiting movement of the switch handle 76.

The adjustability of the fastener 124 allows the universal restraint device 70, 70*a* to be operational with a multiplicity of available brands of electrical switches 72 having a switch handle 76 as large as the maximum size of the channel 86, 86*a*. The fastener 124 may be fixed in a predetermined position relative to the collar member 82, 82*a* by a locking mechanism as described in U.S. Pat. Nos. 5,079,390 and 5,147,991, which are hereby incorporated by reference in their entireties.

Figure 9:
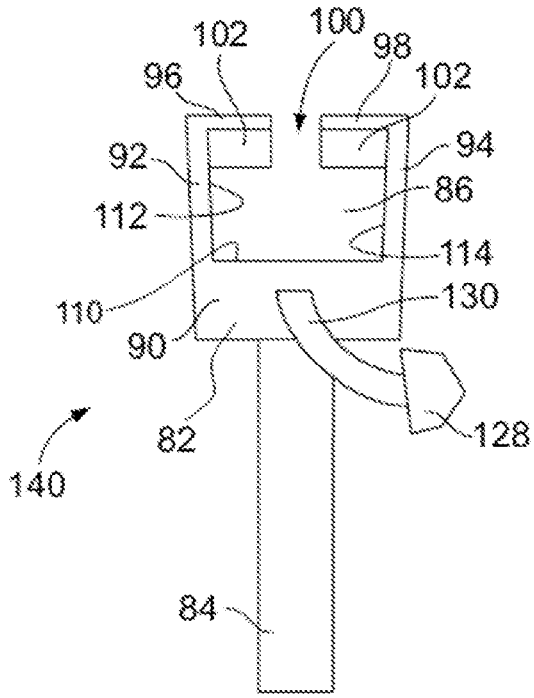
FIG. 9 is an elevational view of a first side of a further embodiment of a universal restraint device.

Referring to FIG. 9, another embodiment of a universal restraint device 140 includes a shim 128 that may be inserted between the interior surface 110 of the base wall 90 and the surface 88 of the switch handle 76. The shim 128, like the fastener 124, helps keep the collar member 82 engaged with the switch handle 76 and transfers the hereinabove described reaction force produced in the blocking member 84 to the surface 88 of the switch handle 76. The shim 128 may be manufactured from an elastic material such that any deformation caused in the shim 128 by inserting the shim 128 between the switch handle 76 and the collar member 82 may be recovered. Suitable materials for the shim 128 may be plastic and/or rubber. The shim 128 may be attached to the universal restraint device 140 by a strap 130. A further embodiment of a universal restraint device (not shown) includes the shim 128 attached to the collar member 82*a*.

The adjustability of the universal restraint device 70, 70*a*, 140 not only allows for utility on a wide range of switch handle shapes and sizes but also allows a user to quickly and simply restrain an electrical switch from being actuated. This flexibility and ease of installation may save time in comparison to more complex devices intended only for tamper proof or more permanent installation. The universal restraint device 70, 70*a*, 140 described hereinabove may require less material to manufacture than known larger and bulkier restraint devices, thereby providing an economical benefit in cost of material. Further, the open nature of the second end 108 of the channel 86, 86*a* allows a user to see indicia such as brand, model, or amperage rating that may be printed or embossed on a distal end of the switch handle 76.

While the present invention may be embodied in many forms, multiple embodiments are discussed herein with the understanding that embodiments illustrated are to be considered only as an exemplification of the invention and are not intended to limit the disclosure to the embodiments illustrated. For example, although the universal restraint device 70, 70*a*, 140 is described hereinabove with regard to a circuit breaker switch, the universal restraint device 70, 70*a*, 140 is also operable with wall mounted light switches. Further, it should be understood that the universal restraint device 70, 70*a*, 140 is not limited to use with electrical switches. The universal restraint device 70, 70*a*, 140 can be dimensioned to operate with any manual switch adapted to be selectively displaced in an ON or OFF position. It should be understood that the universal restraint device 70, 70*a*, 140 can engage a switch in both an upright and inverted position to prevent downward and upward movement, respectively, of the switch handle 76.

INDUSTRIAL APPLICABILITY

A universal restraint device for a switch handle is presented that includes an adjustable collar member and a lever arm that is sized to be longer than a maximum internal transverse dimension of the collar member. The configuration and length of the lever arm and the adjustable size of the collar member allow the universal restraint device to be quickly and easily applied to a variety of switch handle shapes and sizes.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety

We claim:

1. A universal restraint device for a switch handle that projects through an aperture in a switch housing, the universal restraint device comprising:

a collar member forming a channel therethrough and adapted to engage the switch handle, wherein the channel is defined by a base wall, a side wall that extends generally perpendicularly from the base wall, and a top wall that extends generally perpendicularly from a distal end of the side wall, such that the ends of the top and base walls opposite the side wall have an open gap therebetween; and a blocking member extending from the collar member and configured to contact the switch housing external to the aperture when the collar member engages the switch handle.

2. The universal restraint device of claim 1, wherein a surface of the blocking member is substantially parallel to the switch housing external to the aperture when the collar member engages the switch handle.

3. The universal restraint device of claim 1, wherein the switch handle extends entirely through the channel of the collar member when the collar member engages the switch handle.

4. The universal restraint device of claim 1, wherein the blocking member has a long dimension greater than the greatest dimension measured transversely across the channel between opposite surfaces thereof.

5. The universal restraint device of claim 1, wherein the blocking member has a generally rectangular shape.

6. The universal restraint device of claim 1, wherein the blocking member has a short dimension less than the greatest dimension measured transversely across the channel between opposite interior surfaces thereof.

7. The universal restraint device of claim 1 further comprising a shim insertable between the collar member and the switch handle.

8. The universal restraint device of claim 7, wherein the shim is integrally formed with the collar member.

9. The universal restraint device of claim 1, wherein the universal restraint device is formed from a material selected from the group consisting of steel, stainless steel, copper, aluminum alloy, polyethylene, polyvinyl chloride, and polypropylene.

10. A universal restraint device for a switch handle comprising:

a channel adapted to accommodate the switch handle and having first and second planar ends, wherein the channel comprises a base wall, a side wall that extends generally perpendicularly from the base wall, and a top wall that extends generally perpendicularly from a distal end of the side wall, such that the ends of the top and base walls opposite the side wall have an open gap therebetween; and a lever arm extending from the channel a distance greater than the greatest dimension measured transversely across the channel.

11. The universal restraint device of claim 10, wherein a surface of the lever arm is substantially parallel to the first planar end of the channel and wherein the planar ends are each an open face of the channel.

12. The universal restraint device of claim 10, wherein the universal restraint device is formed from a single continuous piece of material selected from the group consisting of steel, stainless steel, copper, aluminum alloy, polyethylene, polyvinyl chloride, and polypropylene.

13. The universal restraint device of claim 10, further comprising a shim insertable between the channel and the switch handle.

14. The universal restraint device of claim 13, wherein the shim is integrally formed with the channel.

15. A universal restraint device for a switch handle comprising:

a channel adapted to accommodate the switch handle, wherein the channel includes a base wall, first and second side walls that extend generally perpendicularly from the base wall, and first and second feet that extend toward one another from distal ends of the first and second side walls, wherein the channel includes a width defined by a distance measured between the first and second side walls, wherein the first and second feet are not connected and define a gap therebetween; and a lever arm that extends from the base wall a distance greater than the width of the channel.

16. The universal restraint device of claim 15, wherein first and second ends of the channel are generally planar.

17. The universal restraint device of claim 16, wherein a surface of the lever arm extends from the base wall substantially parallel to the first end of the channel.

18. The universal restraint device of claim 15 further comprising a threaded aperture disposed through the base wall.

19. The universal restraint device of claim 18 further comprising a set screw threadably engaged within the threaded aperture.

20. The universal restraint device of claim 15, wherein the universal restraint device is formed from a material selected from the group consisting of steel, stainless steel, copper, aluminum alloy, polyethylene, polyvinyl chloride, and polypropylene.

* * * * *